United States Patent [19]

Statham

[11] Patent Number: 4,826,353

[45] Date of Patent: May 2, 1989

[54] PROTECTION OF MARINE INSTALLATION FROM MOVING ICE

[76] Inventor: John A. Statham, 4 Kennet Park, Bathampton, Bath, BA2 6SS, United Kingdom

[21] Appl. No.: 97,811

[22] Filed: Sep. 16, 1987

[30] Foreign Application Priority Data

Oct. 1, 1986 [GB] United Kingdom ..... 8623627

[51] Int. Cl.[4] ..... E02B 15/02

[52] U.S. Cl. ..... 405/61; 114/42; 188/83; 188/335; 405/211; 405/217

[58] Field of Search ..... 405/61, 217, 211, 195; 114/41, 42, 40; 188/74, 78, 83, 335, 365; 62/259, 260

[56] References Cited

U.S. PATENT DOCUMENTS

| | | | |
|---|---|---|---|
| 2,176,927 | 10/1939 | Sauzedde | 188/335 X |
| 2,545,104 | 3/1951 | Musial | 405/61 X |
| 3,001,313 | 9/1961 | Long | 405/61 X |
| 3,075,620 | 1/1963 | Roe | 188/74 X |
| 4,077,225 | 3/1978 | Lichtenberger et al. | 405/61 X |
| 4,348,059 | 9/1982 | Morgan | 405/61 X |
| 4,350,114 | 9/1982 | Schirtzinger | 405/61 X |
| 4,468,152 | 8/1984 | Lamy et al. | 405/61 |
| 4,547,093 | 10/1985 | Statham | 405/61 |

FOREIGN PATENT DOCUMENTS

| | | | |
|---|---|---|---|
| 0156789 | 12/1980 | Japan | 114/42 |
| 499379 | 3/1976 | U.S.S.R. | 405/61 |
| 0590182 | 1/1978 | U.S.S.R. | 114/42 |

*Primary Examiner*—Dennis L. Taylor

*Attorney, Agent, or Firm*—Flynn, Thiel, Boutell & Tanis

[57] ABSTRACT

A drag unit to absorb the kinetic energy from large floating bodies of ice is constructed around a buoyancy chamber (14). The buoyancy chamber is attached to a torque arm (16) and this is secured at its remote end to an anchor line (6). The buoyancy chamber supports a rotatable drag wheel (20) at either end. The drag wheels each have a plurality of sharp impeller blades on their outer surfaces. The drag wheels are impeded from rotation by brakes (40) attached to the buoyancy chamber (14), the brakes being energized hydraulically from a high pressure gas chamber (71). When a large mass of ice contacts the drag wheels, a braking force determined by the pressure in the gas chamber (71) is applied to the ice, thereby reducing its speed.

18 Claims, 6 Drawing Sheets

PROTECTION OF MARINE INSTALLATION FROM MOVING ICE

BACKGROUND OF THE INVENTION

This invention relates to means for protecting marine installations such as offshore drilling and production installations in polar waters from large floating ice formations.

More specifically it relates to an energy absorbing system, which converts the kinetic energy of large ice structures into heat and power; the power being stored and used to energise, monitor and control, so that difficulties of control can be overcome.

A number of ways exist for absorbing the kinetic energy of ice formations in polar waters. One way is to construct a gravel island on the seabed, with a long sloping beach, up which the ice formations ground.

The gravel island can be improved by containing the top section within a heavy caisson so as to minimise the quantity of filling material.

Another method consists of fabricating a number of large, hollow concrete horizontal slabs which can be floated into position and sunk onto the seabed stacked on top of each other. The finished face of the outer wall is shaped so that the advancing ice is forced upward until the horizontal motion becomes vertical and is absorbed by gravity.

A fourth method is to create underwater obstacles, sometimes in the form of a vertical wire fence, anchored to the seabed, against which the advancing ice keels will collide.

A fifth method is by creating an underwater circle of drag elements (as described in my U.S. Pat. No. 4,547,093 of Oct. 15, 1985) which are attached to seabed anchorages by long anchor lines, the drag elements having teeth which penetrate the underside of the ice and absorb the kinetic energy of the ice formation by their shearing action.

All these methods suffer from very real disadvantages. The artificial islands are very expensive and take a long time to construct even in shallow water. Removal is an even greater problem. The caisson retained top helps to minimise the cost, but there are still time and cost problems. Concrete slabs stacked on top of each other have the advantage of re-use on a number of different sites in different seat water depths, but they become very large and expensive in deep water especially if they have to resist the collision impact force from a large ice island. Sea obstructions can be destroyed too easily by a large ice keel, and repair is not possible during the winter season. Drag elements can be very effective with fast moving ice but they suffer from the disadvantages that the drag force cannot be controlled, the teeth-freeze into very slow moving ice, and there can be a tendency for following pack ice to overslide ice slabs held on the drag elements.

SUMMARY OF THE INVENTION

The invention provides a drag unit which will absorb the kinetic energy from floating ice formations. This is constructed around a buoyancy chamber which carries one or more drag wheels. The drag wheels have sharp impeller blades which project outwards and penetrate the ice as they are forced upwards by the buoyancy chamber. The buoyancy chamber has a torque arm attached to it, the distal end of which is attached to an anchor line which is fixed to the sea bed. If an ice formation in contact with the drag wheels is moving, then the drag wheels will rotate. Brakes are fitted to the buoyancy chamber to engage the drag wheels. These absorb rotational energy from the drag wheels and thus absorb kinetic energy from the moving ice formation. The torque created by the brake system is countered by the torque and anchor. The heat generated by the brake system is used to heat the surrounding water. This has the additional advantage of preventing ice from forming between the impeller blades.

The invention may also provide each drag float with a monitoring, control, and energising system whereby the brake pressure can be controlled according to the rotary velocity of each drag wheel, the anchor line tension, and the orientation of the anchor line; also the anchor line length may be controlled according to the water pressure at each drag wheel centre.

The drag units surround the installation being protected basically, in the same manner as that described in U.S. Pat. No. 4,547,093 of Oct. 15, 1985, but are more effective because of their ability to overcome polar problems.

DETAILED DESCRIPTION OF THE PREFERRED EMBODIMENTS

Figure 1:
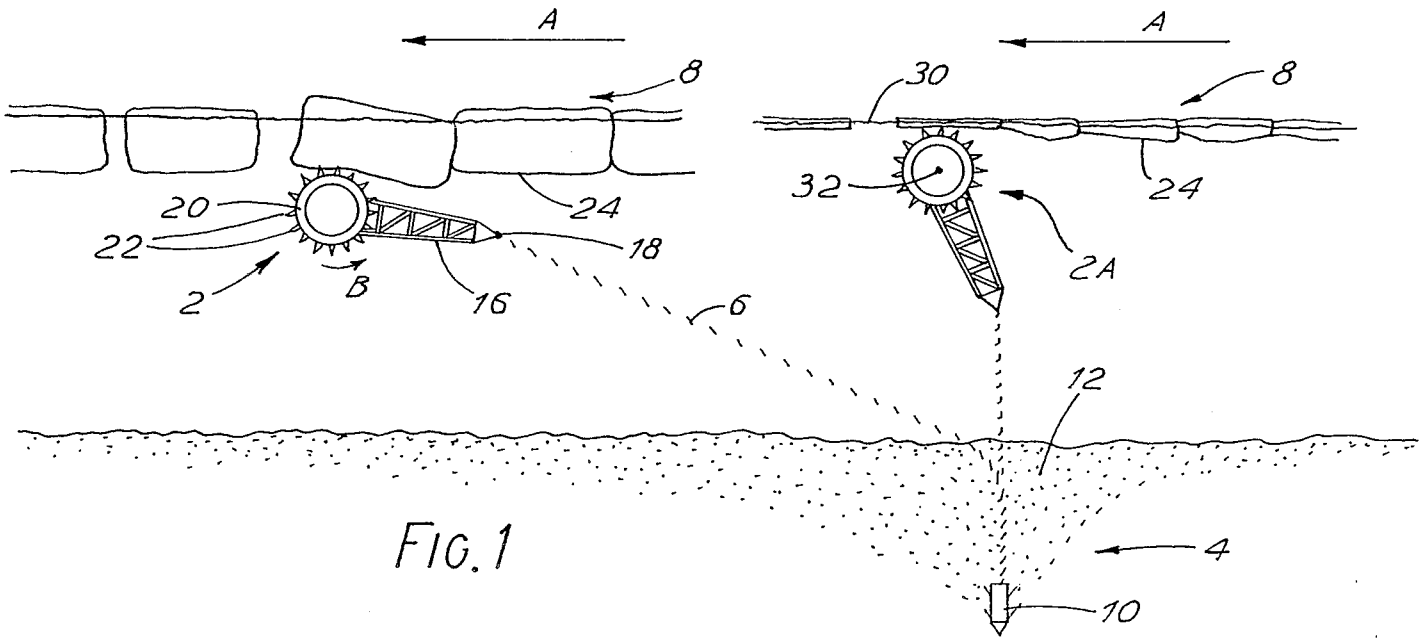
FIG. 1 is a schematic side elevation of a first embodiment of a drag unit working under pack ice.
Figure 2:
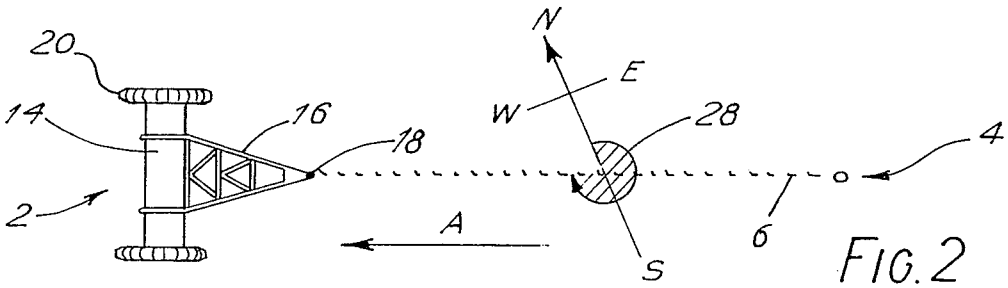
FIG. 2 is a plan of the drag unit shown in FIG. 1.

Referring first to FIGS. 1 and 2, a drag unit comprises a drag float 2 connected to an anchorage 4 by an anchor line 6. Pack ice 8 is moving in the direction indicated by the arrow A.

The anchorage 4 consists of an anchor 10 buried in the seabed 12.

The drag float consists of an enlongated buoyancy chamber, 14, to which a rigid torque arm, 16, is attached centrally. The anchor line is attached to the remote end of the torque arm at the attachment point, 18. A drag wheel, 20, is conveniently connected to each end of the buoyancy chamber and each drag wheel is surrounded by a number of sharp impeller blades, 22, which (because of the upward force provided by the buoyancy chamber) impinge on the underside, 24, of the pack ice, moving overhead, and gain rotation from it. As the impeller blades are set at right angles to the plane of rotation of the drag wheels and as the drag float is held by the anchor line, the linear motion of the ice results in a rotary motion of the drag wheels indicated by the arrow B.

As the drag float is carried away from the anchorage by the pack ice, the orientation, 28, of the anchor line about the anchorage, shown in FIG. 2, must coincide with the orientation of the pack ice motion.

When the surface of the water, 30, is covered wtih thin ice the anchor line has to be shortened to ensure that the impeller blades do not break through the surface of the water and become fouled by ice. This situation is shown at 2A, in FIG. 1 and is effected by the control system which takes account of the water pressure given by pressure gauges, 32, located at the centre of each drag wheel.

Figure 4:
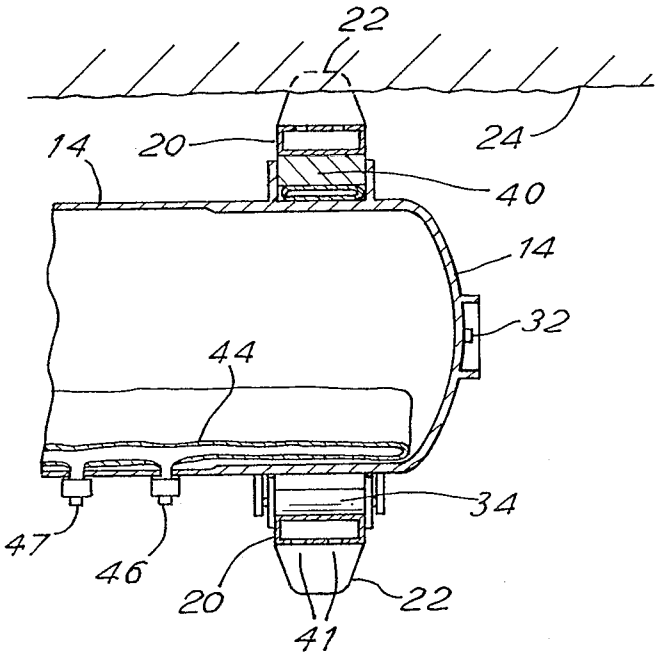
FIG. 4 is a part section along the line YY of FIG. 3.
Figure 3:
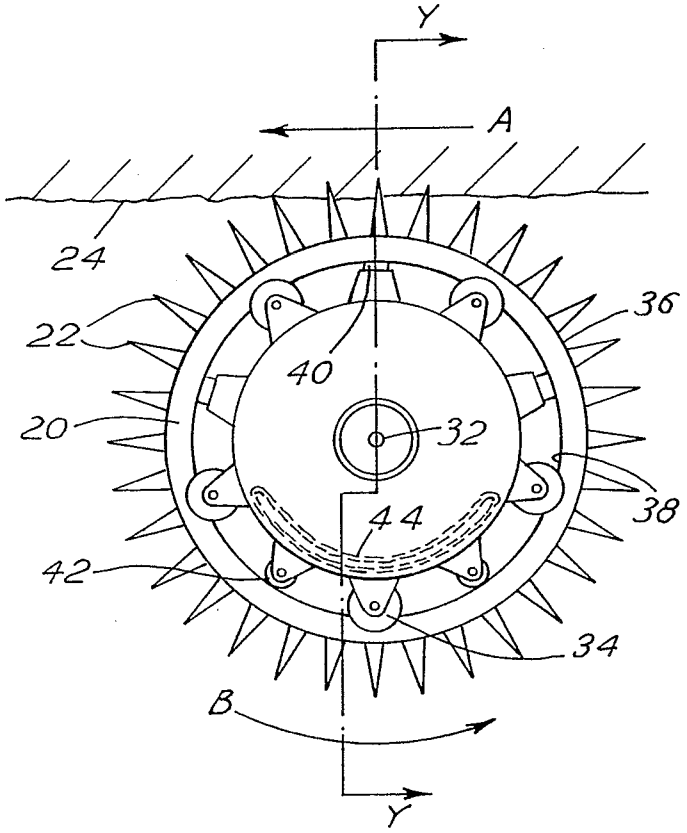
FIG. 3 is an enlarged side elevation of a drag wheel.

As shown in FIGS. 3 and 4 ach drag wheel is a circular hollow rectangular box conveniently supported on a number of flanged rollers, 34, on the end of the buoyancy chamber so that it can freely rotate about the longitudinal axis of the buoyancy chamber. The impeller blades are rigidly attached to the outer flange on surface 36, of the drag wheel so that the blades are at right angles to the plane of rotation of the drag wheel. As well as being used as a supporting surface for the flanged rollers, the inner flange or surface, 38, of the drag wheel is used as a braking surface for a number of brake blocks, 40, and the operating surface for one or more power take-offs, 42, which supply to power for the control and energy storage systems.

The outer flange of the drag wheel is perforated by a number of holes, 41, to allow water to circulate. Under working conditions the inner flange of the drag wheel is heated by the brake block friction. Cold sea water enters the drag wheel through the bottom holes, flows up through the hollow drag wheel and emerges as hot water through the top holes, creating a cooling cycle for the brake system.

The drag float may be forced deep down into the water by a deep ice keel and is designed so that the shell of the buoyancy chamber is never in compression. To achieve this the buoyancy chamber is pressurised with a gas so that it can withstand a certain design water pressure. It is also equipped with a water pressure compensating bag, 44, which has an inlet valve, 46, and an outlet valve, 47 both of which communicate with the outside sea water. The inlet valve is set to allow external water to enter the bag when the external water pressure exceeds the design water pressure mentioned above. The outlet valve is a simple non-return valve which allows water only to leave the buoy. By this system the weight of the buoyancy chamber can be minimised due to the reduction in pressure differential across the buoyancy chamber walls caused by the filling of the pressure compensating bag when the buoyancy chamber is subjected to a pressure greater than the design water pressure. This enables the chamber walls to be thinner than would otherwise be the case.

The brakes are operated hydraulically by fluid pressure applied to force the brake blocks, 40, outwards onto the drag wheel inner flange. Return springs, not shown, force the brake blocks clear of the flange when the brake pressure is released. When ice is moving overhead the application of the brakes transmits a drag force to the ice surface and tends to rotate the drag float about the axis of the drag wheels. This rotation is counteracted by the anchor line (which will be in tension) acting eccentrically at its attachment point at the remote end of the torque arm so that torque stability is achieved.

The basic stability of the drag float is achieved by a three point support. The drag float is supported by the two drag wheels acting upwards on the underside of the ice and by the anchor line acting at the attachment point; and these three points of support form a roughly isosceles triangle.

Power take-off wheels, 42, are forced against the inner flange of the drag wheel and are rotated by it. The power take-off system is designed to generate energy in whichever direction the drag wheel rotates.

Figure 5:
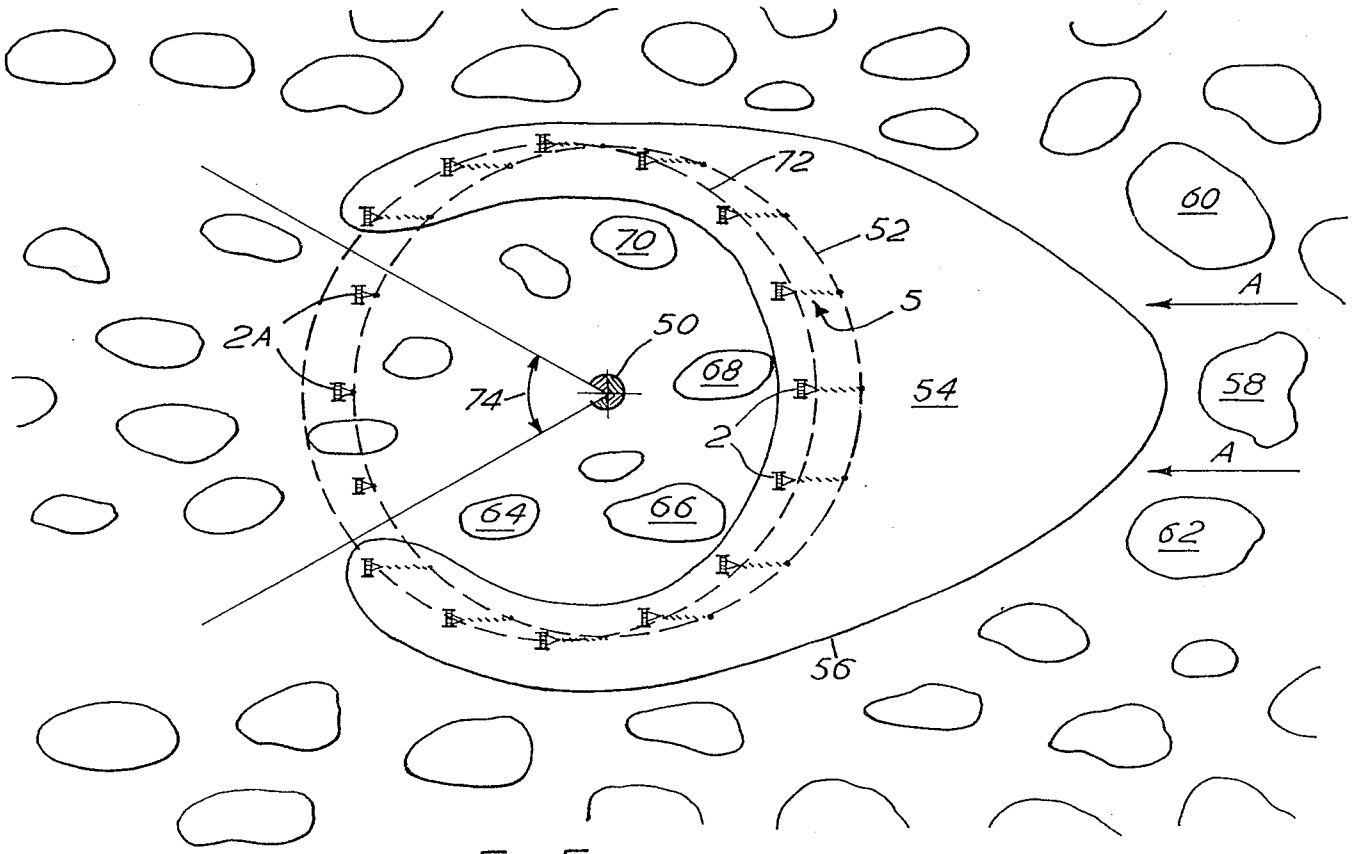
FIG. 5 is a schematic plan view of a circular array of drag units protecting an arctic installation.

A drag defence system consists of a number of drag units installed to protect a polar installation. Such a system is shown diagramatically in FIG. 5. Although the drag floats would be working under the ice the lines of the floats are shown here in solid lines for clarity. The drag units, 5, are set to defend the installation, 50, from any direction from which threatening ice structures 58, 60 and 62 might approach. This usually results in a circular array such as that shown, the anchors being set out on anchor circle 52. The de-energising effect of the drag floats create a slow moving floating island of compact pack ice, 54, shown bounded by line 56. Ice structures, 58, 60 and 62, floating in a sea of pack ice, not shown, will probably be deflected by the island, but they will all strike the island and give up some of their energy to it. Other energy will be lost by rafting, crushing and spinning, resulting from collisions. Ice structure 58 may become embedded in the island and become part of it. Freed ice structures 64, 66, 68 and 70 are no longer held by the drag defence system and are floating slowly across the drag circle 72. The drag floats 2A which lie within the downstream sector 74 will have had their anchor lines shortened and their brakes released by their control systems. They will be generating and storing a little power, because of the moving ice, but will not be breaking the water surface. The downstream sector is determined so as to allow as many upstream sector drag floats to participate in the total drag defence and also to allow freed ice structures to pass out of the drag circle with only slight hindrance—their motion will only be used to generate and store power for the control systems.

Monitoring and control is a very important function which has to be performed automatically at each drag float. The following information has to be relayed to the control system either constantly or intermittently:

(1) The rotary velocity of each drag wheel
(2) The anchor line tension
(3) The anchor line orientation
(4) The water pressure at the centre of each drag wheel The anchor line orientation determines whether the drag float is in the downstream sector; if it is the brakes must be released by the control system in order to allow ice to exit from the drag circle.

The impeller blades must never be allowed to break through the water surface. When the water pressure indicates that the impeller blades are near the water surface the anchor line must be shortened by the control system, and when the pressure increases again the anchor line must be extended.

There is a danger that ice held by the impeller blades may be overslid by thin following ice. If this happens the drag float will lose its effectiveness. To avoid this circumstance the anchor line tension, and the drag wheel rotary velocities must be regularly monitored. When both the transmission and the rotary velocities are low the brakes must be released by the control system to release ice held by the impeller blades. After a pause the brakes should be re-applied.

When the anchor line tension nears the upper safety limit the brakes must be released by the control system until the tension falls to the normal working level.

A winch is provided to shorten and lengthen the anchor line, a hydraulic pump to operate the brakes and a computer to analyse the input information received from the monitors and to operate the winch and brake controls automatically according to the intstructions given in a computer program. An energy storage system is also provided.

Anchor line tension is obtained by installing a tensometer near the anchor line attachment point so that the anchor line has to run through the three pulleys of the tensometer before leaving the drag float.

The orientation of the anchor line can be measured and the sector determined in a similar manner to that described in my U.S. Pat. No. 4,547,093.

One embodiment of the invention envisages a drag circle diameter of 10,000 meters around an arctic oil production facility in 60m of water. Drag floats having an upthrust of $30^t$ and a drag force of $40^t$ would be used and would be anchored at 126 meter centres on the anchor circle. An ice island of 3000 million tonnes mass travelling towards the installation at 40cm per sec. would be stopped in 5 hours and 40 minutes, travelling 4070 meters after striking this defence system, if it were on an exact collision course. However, the chances of such an island keeping on the exact course are very slight and it is likely that this huge mass would be deflected by the drag defence system and would pass to one side of the drag circle. 250 drag units would be required for 360° protection. The buoyancy chamber would be a steel tank 2.5 meters diameter by 17 meters long, 5 meter diameter drag wheels would be mounted on each end, and the overall diameter of the impeller blade tips would be 6 meters.

Figure 6:
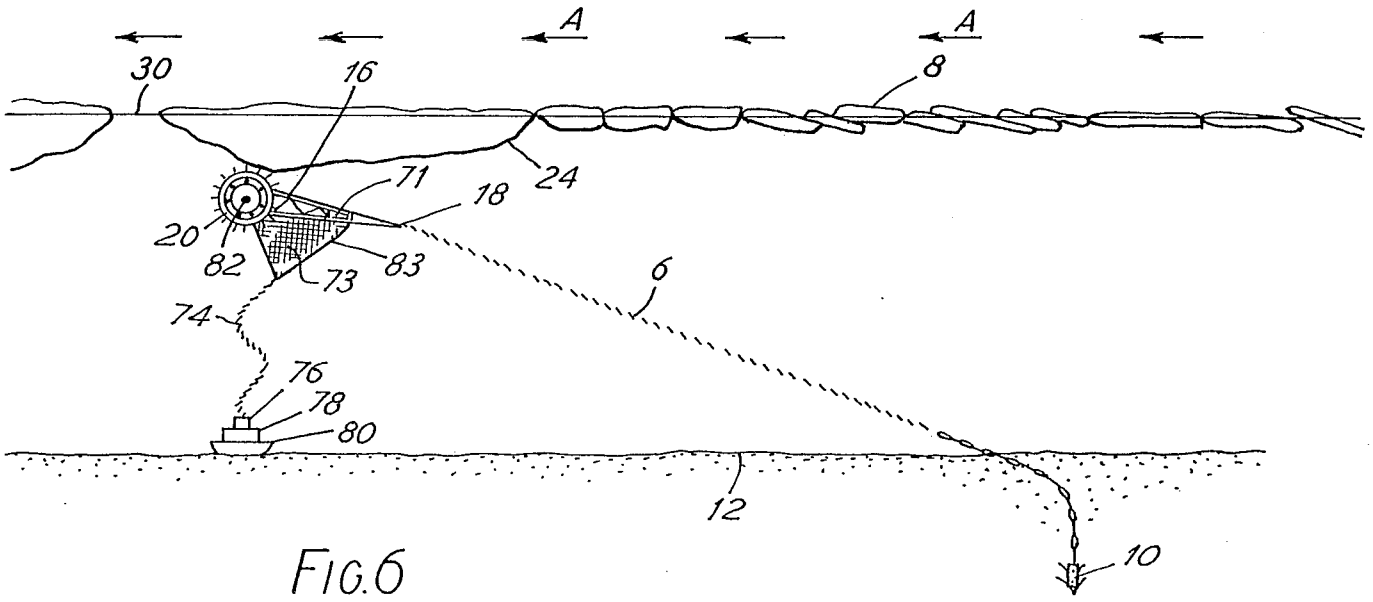
FIG. 6 is a schematic side elevation of a second embodiment of a drag unit.
Figure 7:
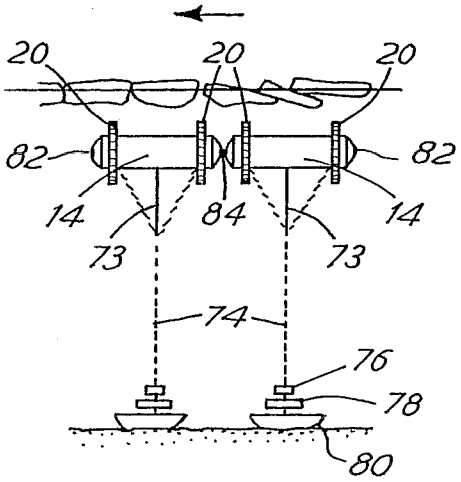
FIG. 7 is an end view of the drag unit shown in FIG. 6.
Figure 8:
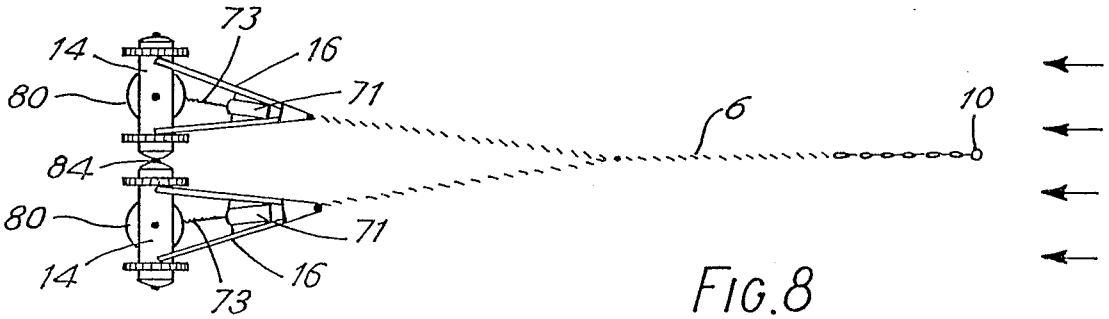
FIG. 8 is a plan view of the drag unit shown in FIG. 6.

FIGS. 6, 7 and 8 show side, end and plan views of a second embodiment of a drag unit. This second embodiment is a modified version of the first embodiment, the most important difference being that it includes no power generating and storage means.

In this embodiment, a second buoyancy chamber 71 is fitted in the remote end of the torque arm 16. This chamber is normally filled with high pressure gas which serves to energise the brakes on the drag wheels 20. It also serves to raise the torque arm and thus open up a flexible sail or rubber 73 fixed between the torque arm 16 and a second anchor line 74.

The second anchor line is fixed to three dead weights 76,78,80 resting on the seabed 12. The dead weights 76,78 and 80 are connected by additional short lengths of anchor line and are respectively of increasing weight, 76 being the lightest and 80 the heaviest.

In this second embodiment, the drag units are normally provided in pairs. The drag units are held together by a lightly stressed central tendon 82 which passes through both of the first buoyancy chambers 14 preferably within a central tube or duct with a squash block 84 between the buoyancy chambers, to act as a hinge. Each pair of drag units may be fixed to the same anchor 10 as is illustrated in FIG. 8. This enables the spacing between anchors to be increased since the drag units are in pairs, or even in threes.

The dead-weights attached to each drag unit by the anchor line 74 are used to keep the drag unit below sea level, the object of this being to ensure that the impeller blades on the drag wheels 20 do not break through the water surface. A typical distance below sea level would be 1–2m at low tide. The combination of the dead weights and drag unit must therefore be slightly non-buoyant.

When a drag unit is in contact with a large ice structure, as is the case in FIG. 6, the dead wights 76, 78 and 80 will all rest on the seabed. As the ice structure moves over and away from the drag unit, the drag unit will rise towards the surface of the water. Heavy impact loading due to the anchor line 74 snapping taut will be reduced by the dead weights being consecutively lifted from the seabed and thus slowing down the rate of rise of the drag unit.

The buoyancy chamber in this emboidment is again fitted with a water pressure compensating bag as described in the first embodiment of the invention.

The sail or rudder 73 fitted between the anchor line 74 and the torque arm 16 is used to ensure that the drag unit will align itself according to the direction of the current so that the drag wheels will be able to rotate in the direction of movement of the ice. The sail thus acts in a similar manner to a weathervane.

In order to ensure that the sail or rudder 73 opens up, it is necessary to provide a buoyant torque arm. The second buoyancy chamber 71 in the torque arm causes the torque arm to be buoyant thus opening the sail 73. To avoid putting any unnecessary stress on the sail, a tie line 83 links the torque arm 16 to the anchor line 74 thus limiting the angle that can open out between them.

The second buoyancy chamber 71 is also used to energise the brakes 40 on the drag wheels. To do this, the buoyancy chamber is filled with high pressure gas and connected to the brakes by either rigid or flexible piping. The gas acts as a spring for the operation of the brakes. The high pressure used in the chamber is precalibrated to give the required drag force on the drag wheels. This force will be applied continuously instead of varying with the speed of rotation of the wheels. The high pressure is necessary when the drag is forced low down into the water by a deep ice keel and the external water pressure rises.

Thus the second buoyancy chamber 71 serves two purposes. It raises the torque arm and opens out the sail, and it provides a large capacity energy storage system in the form of compressed gas. It is thus unnecessary to have a power generating means in the drag unit, the brakes being energised by the compressed gas and the drag unit being kept a constant distance above the seabed by the dead weights.

Figure 9:
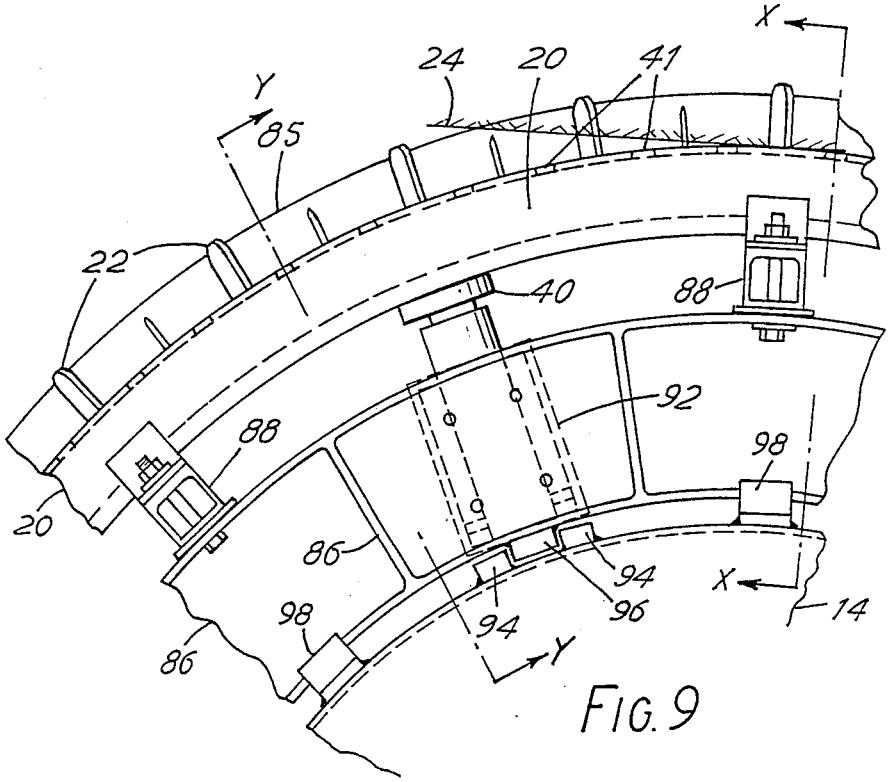
FIG. 9 is a portion of a side elevation of a drag wheel.
Figure 10:
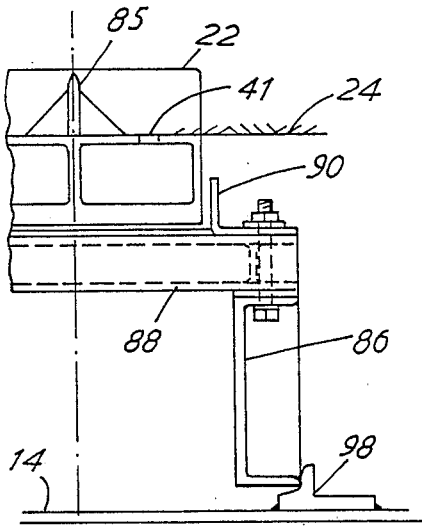
FIG. 10 is a radial half section through a drag wheel along XX of FIG. 9.
Figure 11:
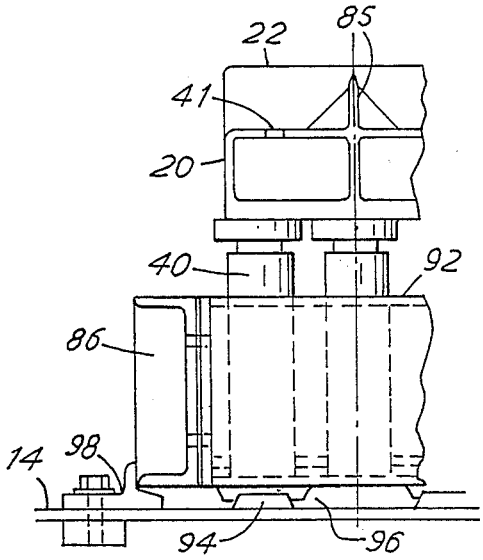
FIG. 11 is a second radial half section through a drag wheel along YY of FIG. 9.

The drag wheel illustrated in FIGS. 9, 10 and 11 has several improvements over that illustrated in FIGS. 3 and 4. The impeller blades 22 are corrugated as opposed to being spiked. This gives them a much greater strength to weight ratio. Holes 41 to enable water to circulate through the drag wheel are again provided. The water is thus able to conduct away heat generated by the brakes. A central fin 85 on the drag wheel 20 helps align the drag wheel in the direction of the current.

The drag wheel is held in position by support frames 86. Bolted to the support frames 86 are cross members 88, the outer surfaces of which are covered with a low-friction, high wear-resistent material. Side supports 90 are bolted to the cross members to prevent any lateral movement of the drag wheel. The use of the low friction material means that roller bearings are not used for the drag wheel, thus saving cost.

The brake actuators 40 are housed in cross frames 92 fixed between the circular support frames 86. Typically the cross frames 92 are arranged alternately with the cross members 88. Torque is transmitted from the brakes 40 to the buoyancy chamber 14 by a number of shear blocks 94 fitted around the circumference of the buoyancy chamber, and co-operating with blocks 96 on the cross frames.

The drag wheel support frames 86 are fixed to the buoyancy chamber 14 by a number of locators 98. The outer locators are easily removable so that the drag wheel can easily be removed from the buoyancy chamber for maintenance.

A typical drag defence system using the second embodiment of the drag units would be as follows. The drag units would have buoyancy tanks, 9m long and 3m in diameter each with 2 end-mounted drag wheels of 5m diameter. The brakes would be energised by a second buoyancy chamber in the torque arm, and would be precalibrated to give a braking force of $25^t$ on each drag wheel. 3 buoyancy chambers would be linked together by a central tendon to form a triple drag unit of $150^t$ braking capacity. 200 of these triple drag units would be arranged around 270° for a 27km diameter circle. This arrangement around only part of a circle is only suitable for conditions where the current comes from substantially the same direction all the time as is often the case in winter.

The cost of the installation protected by such drag untis is very high. Also, maintenance of in-situ drag units is very difficult, particularly in winter time. It is therefore very important that the drag units are reliable.

The advantages the current invention has over previous systems in terms of reliability are as follows. The impeller blades do not become clogged with ice because they rotate into water which has been warmed by the heat generated by the braking action. The radial motion of the impellers pulls them out of the ice. The drag force is controlled so the anchor line will not become overstressed. The second embodiment of the invention has no electrical control system and will therefore be less susceptible to breakdowns and also, it will work even for very slow ice movement which in the first embodiment might not have generated sufficient power to operate the unit effectively.

It will be appreciated that there are very many other embodiments of apparatus which could protect an installation in the manner described. Although one drag float, one anchor line, and one anchorage per drag unit are one preferred combination, many combinations could be used. Drag floats could be connected in series or parallel. Stabilisation could be achieved by the use of keels. Drag wheels could be replaced by caterpillar tracks or counter rotating splined drums. The axis of the drag wheels need not coincide with the axis of the buoyancy chamber. Any number and size of drag wheels can be used on a drag float. They can be spring mounted and pivoted in pairs. Buoyancy can be achieved in many other ways. There is no necessity to pressurise the buoyancy chamber or use water pressure equalising bags. Many forms of blades or spikes can be used to penetrate and grip the ice surface. Any number of dead weights can be used. If only one dead weight is used, the strength of the second anchor line will have to be increased to allow for the impact forces. Alternatively a shock absorber could be incorporated in the second anchor line, or an elastic second anchor line could be used. Control of the drag float could also be by diver or umbilical cable. The drag wheels can be prevented from breaking the water surface in other ways such as by compression of the buoyancy gas to allow ingress of sea water. The invention could be used in rivers and lakes as well as in the sea. Anchorages of many forms can be used.

It should be noted that because the power take-off system in the first embodiment is designed to generate energy in whichever direction the drag wheels rotate, and because the impeller blades project above and below the buoyancy chamber, the drag float still works if it happens to spin through 180° when in position 2A.

It should also be noted that in both embodiments the drag units do not need to be replenished from an external power source because they are self-energising.

I claim:

1. A drag unit to absorb the kinetic energy from floating ice formations comprising:

a buoyancy chamber to force the unit against the underside of a floating ice formation;

a torque arm attached to the buoyancy chamber;

an anchor line attached to the distal end of the torque arm;

at least one drag wheel carried by the buoyancy chamber, the drag wheel having a plurality of impeller blades projecting outwards to penetrate the ice, thereby causing the drag wheel to rotate in response to movement of the ice; and braking means fitted to the buoyancy chamber to engage the drag wheel and slow down the speed of rotation of the drag wheel, thereby slowing down the speed of movement of the ice.

2. A drag unit according to claim 1 including a second anchor line attached at one end to the buoyancy chamber and at the other end to a plurality of dead weights, the dead weights being separated by lengths of anchor line and the combination of the dead weights and drag unit being slightly non-buoyant such that with the lowest dead weight on the sea bed the drag unit is beneath sea level.

3. A drag unit according to claim 2 in which a flexible rudder is fitted between the second anchor line and the torque arm.

4. A drag unit according to claim 3 in which a second buoyancy chamber is fitted to the torque arm and raises the torque arm, thereby opening out the rudder.

5. A drag unit according to claim 4 in which the second buoyancy chamber holds compressed gas to energise the braking means.

6. A drag unit according to claim 1 in which the torque arm holds a second buoyancy chamber filled with compressed gas to power the braking means.

7. A drag unit according to claim 1 in which the buoyancy chamber includes a bag to compensate for the water pressure, the bag being filled with and emptied of water through two corresponding nonreturn valves which operate at predetermined differential pressures.

8. A drag unit according to claim 1 in which the drag wheel rotates in contact with a low friction material which coats the surfaces supporting the drag wheel.

9. The drag unit according to claim 1 in which the drag wheel defines an annular chamber with holes leading to the chamber from the outer surface of the drag wheel, whereby water may flow through the drag wheel and conduct heat away from the braking means.

10. A drag unit according to claim 1 in which the impeller blades are corrugated.

11. A drag unit according to claim 1 in which the buoyancy chamber is cylindrical and the drag wheels are fitted circumferentially of the buoyancy chamber.

12. A drag unit according to claim 11 in which the braking means is fitted on to the buoyancy chamber by an abutment on the braking means engaging two corresponding abutments on the buoyancy chamber, whereby relative rotational movement of the buoyancy chamber and braking means is prevented.

13. A drag unit according to claim 1 in which a power generation and storage means is fitted to the drag unit to generate and store power in response to rotation of the drag wheels.

14. A drag unit according to claim 13 in which a monitoring and control unit controls the operation of the drag unit and is powered from the power generating and storage means.

15. A drag unit according to claim 14 in which power generated by the power generation means is used to power the braking means in response to the speed of rotation of the drag wheels under control of the monitoring and control unit.

16. A drag unit according to claim 14 in which the length of the anchor line is altered by a winch in the drag unit in response to signals from pressure transducers on the buoyancy chamber under control of the monitoring and control unit, whereby the drag unit is kept at substantially the same level below sea level when not in contact with ice formations.

17. A drag unit according to claim 1 in which two or more drag units are fitted together by a central tendon.

18. A drag unit according to claim 17 in which squash blocks are fitted between drag units to relieve any bending stress.

* * * * *